US006905388B2

(12) United States Patent
Schoonmaker

(10) Patent No.: US 6,905,388 B2
(45) Date of Patent: Jun. 14, 2005

(54) WATER TOY

(76) Inventor: Michael C. Schoonmaker, 2097 N. Saddlehorse Dr., Wasilla, AK (US) 99654

( * ) Notice: Subject to any disclaimer, the term of this patent is extended or adjusted under 35 U.S.C. 154(b) by 0 days.

(21) Appl. No.: 10/683,770

(22) Filed: Oct. 10, 2003

(65) Prior Publication Data

US 2004/0092201 A1 May 13, 2004

Related U.S. Application Data

(60) Provisional application No. 60/417,587, filed on Oct. 10, 2002.

(51) Int. Cl.[7] ..... A63H 23/00

(52) U.S. Cl. ..... 446/153; 446/156; 446/180

(58) Field of Search ..... 446/153, 156, 446/159, 180, 211, 212, 475; 473/128; 239/569, 229, 236, 241, 240, 99, 101, 70; 137/627.5

(56) References Cited

U.S. PATENT DOCUMENTS

| | | | | | |
|---|---|---|---|---|---|
| 2,081,510 | A | * | 5/1937 | Smart | 137/624.14 |
| 2,601,559 | A | * | 6/1952 | Riblet | 239/97 |
| 3,379,894 | A | * | 4/1968 | Carsten | 307/41 |
| 3,464,628 | A | * | 9/1969 | Chow | 239/97 |
| 4,235,378 | A | * | 11/1980 | Melin et al. | 239/229 |
| D268,279 | S | | 3/1983 | Geller et al. | |
| 4,526,366 | A | | 7/1985 | Kenoun | |
| 4,787,875 | A | * | 11/1988 | Baron et al. | 446/226 |
| 4,991,847 | A | * | 2/1991 | Rudell et al. | 273/138.1 |
| 5,197,913 | A | * | 3/1993 | Suzuki | 446/156 |
| 5,261,603 | A | * | 11/1993 | Driska | 239/211 |
| 5,263,714 | A | * | 11/1993 | Rudell et al. | 273/138.1 |
| 5,338,044 | A | | 8/1994 | Mazursky et al. | |
| 5,385,472 | A | * | 1/1995 | Mullin | 434/126 |
| 5,470,082 | A | * | 11/1995 | Clayton | 273/445 |
| 5,480,336 | A | * | 1/1996 | Blanchard | 446/89 |
| 5,678,825 | A | * | 10/1997 | Clayton | 273/445 |
| 5,704,549 | A | * | 1/1998 | Kephart et al. | 239/236 |
| 5,934,563 | A | | 8/1999 | Gapco | |
| 6,050,501 | A | | 4/2000 | O'Rourke | |
| 6,755,349 | B2 | * | 6/2004 | Beidokhti | 239/17 |
| 2003/0125119 | A1 | | 7/2003 | Jones | |

* cited by examiner

*Primary Examiner*—Bena B. Miller
(74) *Attorney, Agent, or Firm*—Christensen O'Connor Johnson Kindness PLLC

(57) ABSTRACT

A water toy is provided. The water toy includes a housing (15) and an inlet (54) for directing liquid into the housing. The water toy also includes a distribution assembly (30) disposed in the housing and coupled in fluid communication with the inlet. The water toy further includes a plurality of outlets (61), each adapted to direct a stream of liquid (12) out of the housing, the outlets coupled in fluid communication with the distribution assembly, wherein the distribution assembly intermittently directs a stream of liquid (12) out of each of the outlets.

15 Claims, 7 Drawing Sheets

WATER TOY

CROSS-REFERENCE TO RELATED APPLICATION

This application claims the benefit of U.S. Provisional Application No. 60/417,587, filed Oct. 10, 2002, the disclosure of which is hereby expressly incorporated by reference and priority from the filing date of which is hereby claimed under 35 U.S.C. § 119.

FIELD OF THE INVENTION

The present invention relates to water toys and more particularly, to water toys for selectively emitting streams of water.

BACKGROUND OF THE INVENTION

Children, and sometimes adults, enjoy playing with water toys during hot summer days. Often, a sprinkler will be set in a center of a yard and turned on. To cool off, children will run through the sprinkler. During game play, the children may try to reach the sprinkler without getting sprayed by the sprinkler.

Although sprinklers are somewhat effective as a water toy, they are not without their problems. Sprinklers eject water in a pattern that is often easy to predict. Thus, during game play, the players may be able to predict the pattern of spray and easily avoid being hit by a stream of water. Further, sprinklers do not provide a means for readily indicating an end to the game, such as upon achievement of a specific goal or upon the ending of a selected time period. Therefore, there exists a need for a water toy that is reliable, economical to manufacture, provides a sufficiently confusing pattern of water spray, and which indicates to players an end to the game.

SUMMARY OF THE INVENTION

One embodiment of a water toy formed in accordance with the present invention is provided. The water toy includes a housing, an inlet for directing liquid into the housing, and a distribution assembly disposed in the housing and coupled in fluid communication with the inlet. The water toy further includes a plurality of outlets each adapted to direct a stream of liquid out of the housing, the outlets coupled in fluid communication with the distribution assembly, wherein the distribution assembly intermittently directs a stream of liquid out of each of the outlets.

Another embodiment of a water toy formed in accordance with the present invention is provided. The water toy includes a plurality of outlets, a water distribution system for directing intermittent streams of liquid out of each of the outlets, and a timer for indicating an end of a selected duration of play. The water toy further includes a switch for incapacitating the water distribution system from directing intermittent streams of liquid out of each of the outlets upon manual actuation of the switch into a first position by a user.

Still another embodiment of a water toy formed in accordance with the present invention is provided. The water toy includes a distribution assembly for selectively directing an intermittent stream of liquid out of each of a plurality of outlets. The distribution assembly includes a plurality of valves each associated with one of the plurality of outlets. Each of the valves are actuatable between an open position in which a stream of liquid is discharged from one of the plurality of outlets and a closed position in which the stream of liquid is impeded from discharging from the outlet. The water toy further includes a valve drive assembly comprising a rotatable cam having a plurality of lobes, wherein each of the plurality of lobes is adapted to actuate each of the plurality of valves between the open and closed positions as the cam is rotated.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
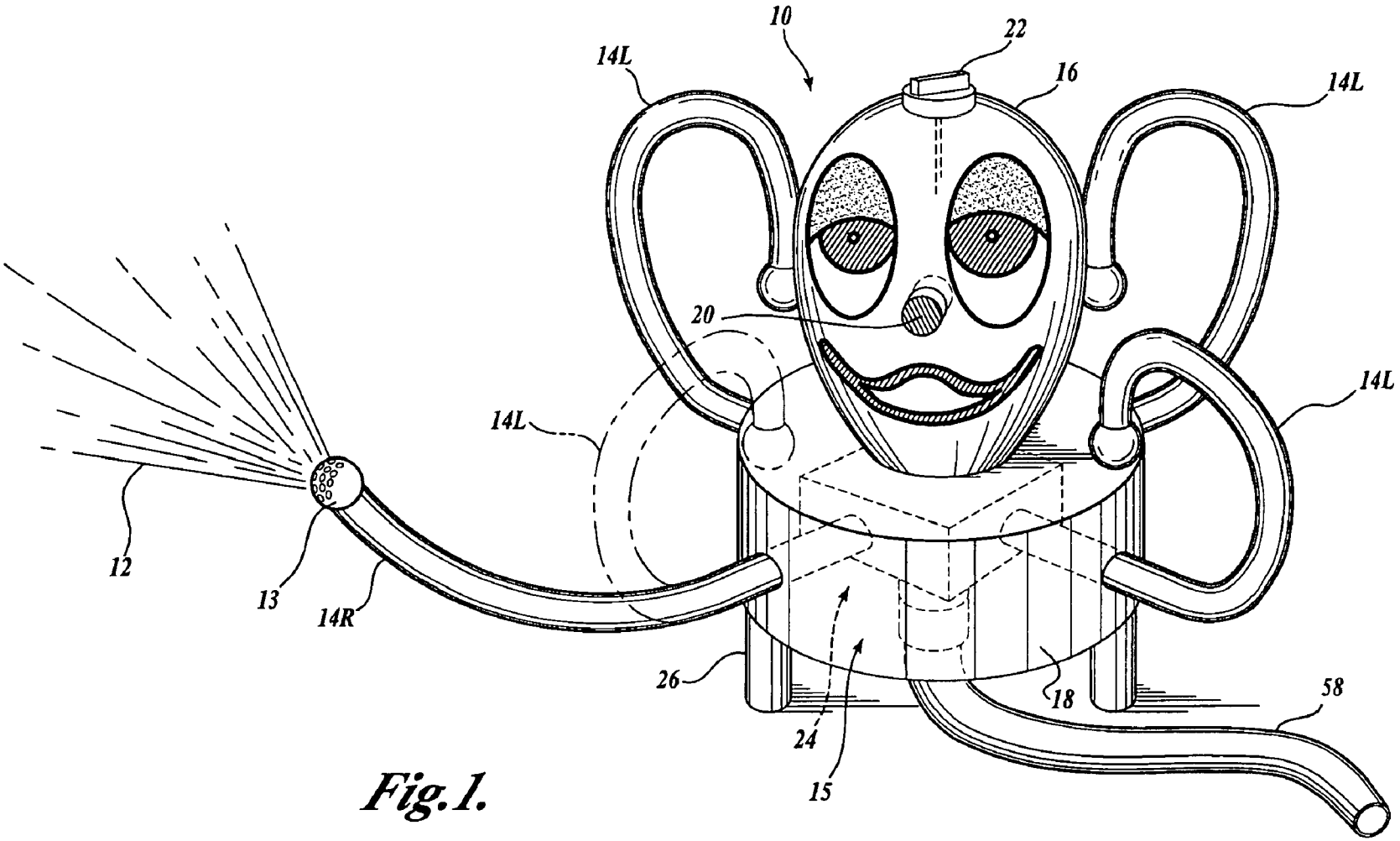
FIG. 1 is an isometric view of one embodiment of a water toy formed in accordance with the present invention, depicting a plurality of arms with one arm in a rigid state emitting a stream of water and the remaining arms shown in a limp, coiled state.

FIGS. 1–6 illustrate one embodiment of a water toy 10 formed in accordance with the present invention. Referring to FIG. 1, generally described, the water toy 10 is adapted to selectively emit a stream of water 12 intermittently out of a nozzle 13 disposed at a distal end of each of a plurality of arms 14. Preferably, the water streams 12 are emitted out of the arms 14 in a sufficiently confusing pattern or firing order so as to appear somewhat random. The arms 14 may eject water streams independently of each other, and/or simultaneously with one or more other arms 14. When an arm 14 is pressurized during emitting of the water stream 12, the arm 14 is configured from a limp state, such as the arms indicated by reference numerals 14L, to a rigid state, such as the arm indicated by reference numeral 14R.

In the illustrated embodiment, the arms 14, when in the limp state, are depicted as being in a coiled position. However, it should be apparent to those skilled in the art, that the arms 14 may take other forms when in the limp state, such as a form where the arms 14 lay upon the ground in any selected or random shape, or form some other selected geometric shape. Further, it should be apparent to those skilled in the art that the arms 14 may take many forms. In the illustrated embodiment, the arms 14 are depicted as tentacles to an octopus or arms of a cartoon character. However, it should be apparent to those skilled in the art that the arms 14 may take any number of forms, including permanently rigid shapes, such as gun bores, etc. Further, although a particular theme for the water toy 10 is depicted and described herein, it should be apparent to those skilled in the art that the theme or look of the water toy 10 is purely illustrative in nature, and may be changed without departing from the spirit and scope of the invention. For instance, the water toy 10 may take the form of a galleon having arms which take the form of cannons for ejecting streams of water therefrom.

Focusing now on the outer structure of the water toy 10, the water toy 10 includes a housing 15 formed from a head portion 16 and a base portion 18. The head portion 16 may include a switch 20. The switch 20 may be used to toggle the water toy 10 between operating conditions, preferably between an off and on state. In the illustrated embodiment, the switch 20 is positioned and configured to be hit by thrown objects. For instance, the switch 20 may be positioned and configured to be hit by small bean bags, rings, balls, or other objects thrown by a user such that an impact by one of the objects upon the switch 20 actuates the switch 20 to configure the water toy 10 between off and on configurations. The head portion 16 may be configured to rotate to increase the difficulty of hitting the switch 20. Alternately, the switch 20 may be toggled by other means, such as by a hand of the user. Further, the switch 20 may be enclosed within the housing 15.

The head portion 16 also includes a timer 22. The timer 22 may be a wind up timer such as illustrated, wherein the timer 22 may be wound a selected amount to operate for a selected duration. The timer 22 may also be of a well known electronic variety, or of any other variety here now known or to be developed. Preferably, the timer 22 indicates to a user the end of a period of play. The timer 22 may indicate the end of a round of play by visual, audio, or other means. For instance, the timer 22 may emit laughter or taunting remarks, flash a light, cease the operation of the water toy 10, or may produce some other indication to the user that the selected amount of time has past.

The base portion 18 is generally cylindrical in shape and houses, along with the head portion 16, an operating assembly 24 of the water toy 10. A plurality of legs 26 may support the base portion 18 above a surface, such as a ground surface.

Figure 2:
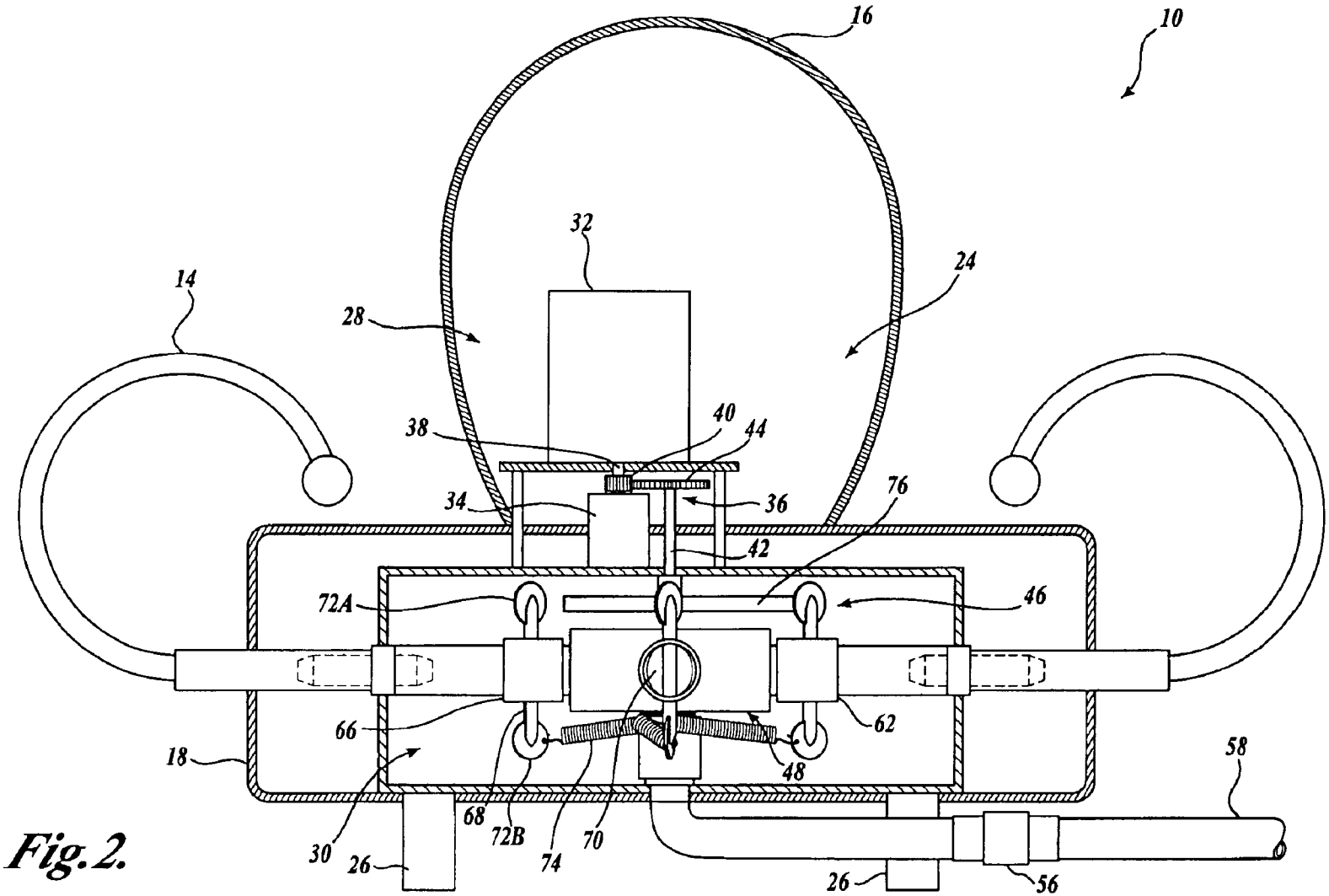
FIG. 2 is an elevation view of the embodiment of FIG. 1, wherein a portion of a housing has been cut away to better show an operating assembly of the water toy disposed therein.
Figure 3:
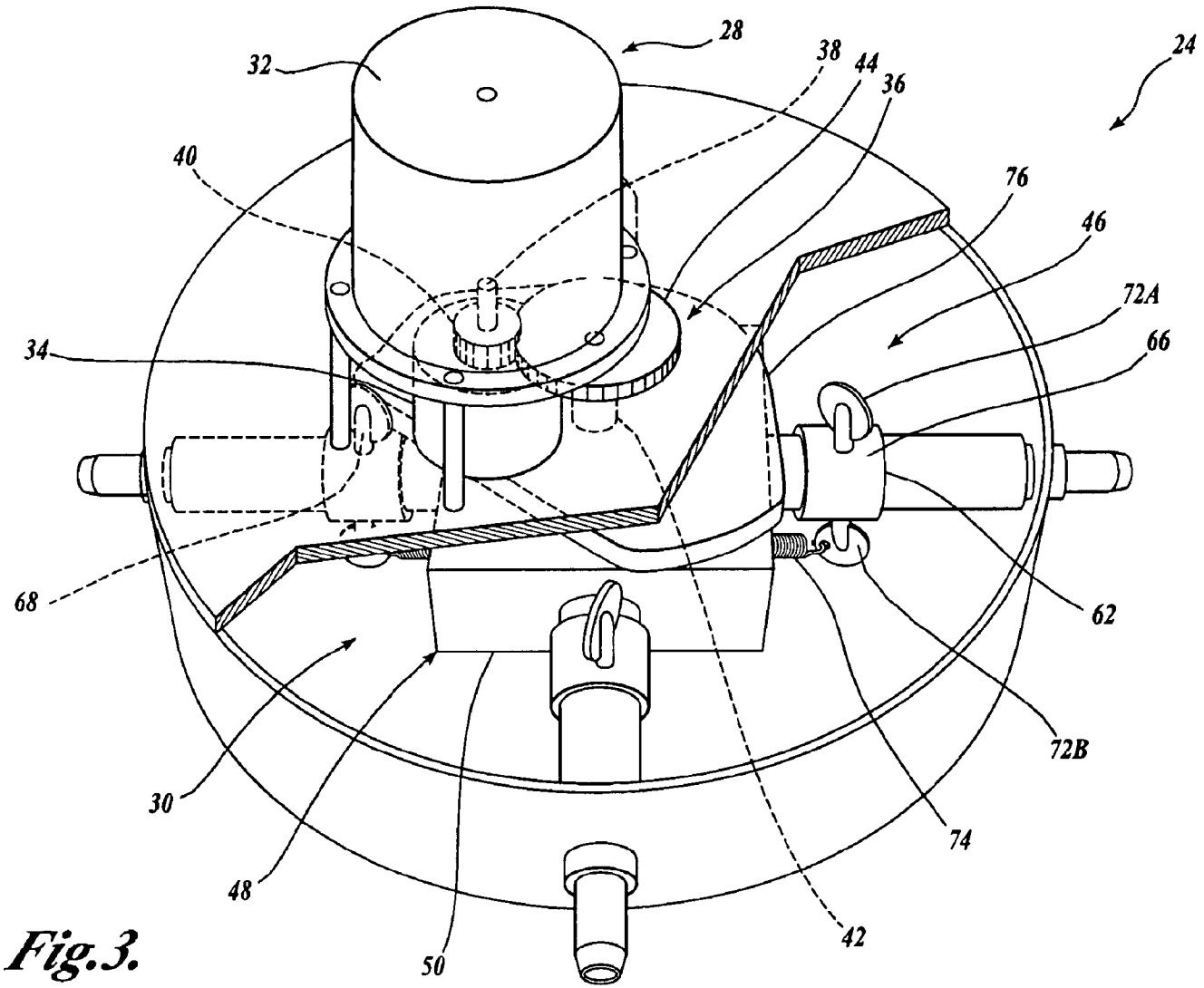
FIG. 3 is an isometric view of the operating assembly depicted in FIG. 2.
Figure 4:
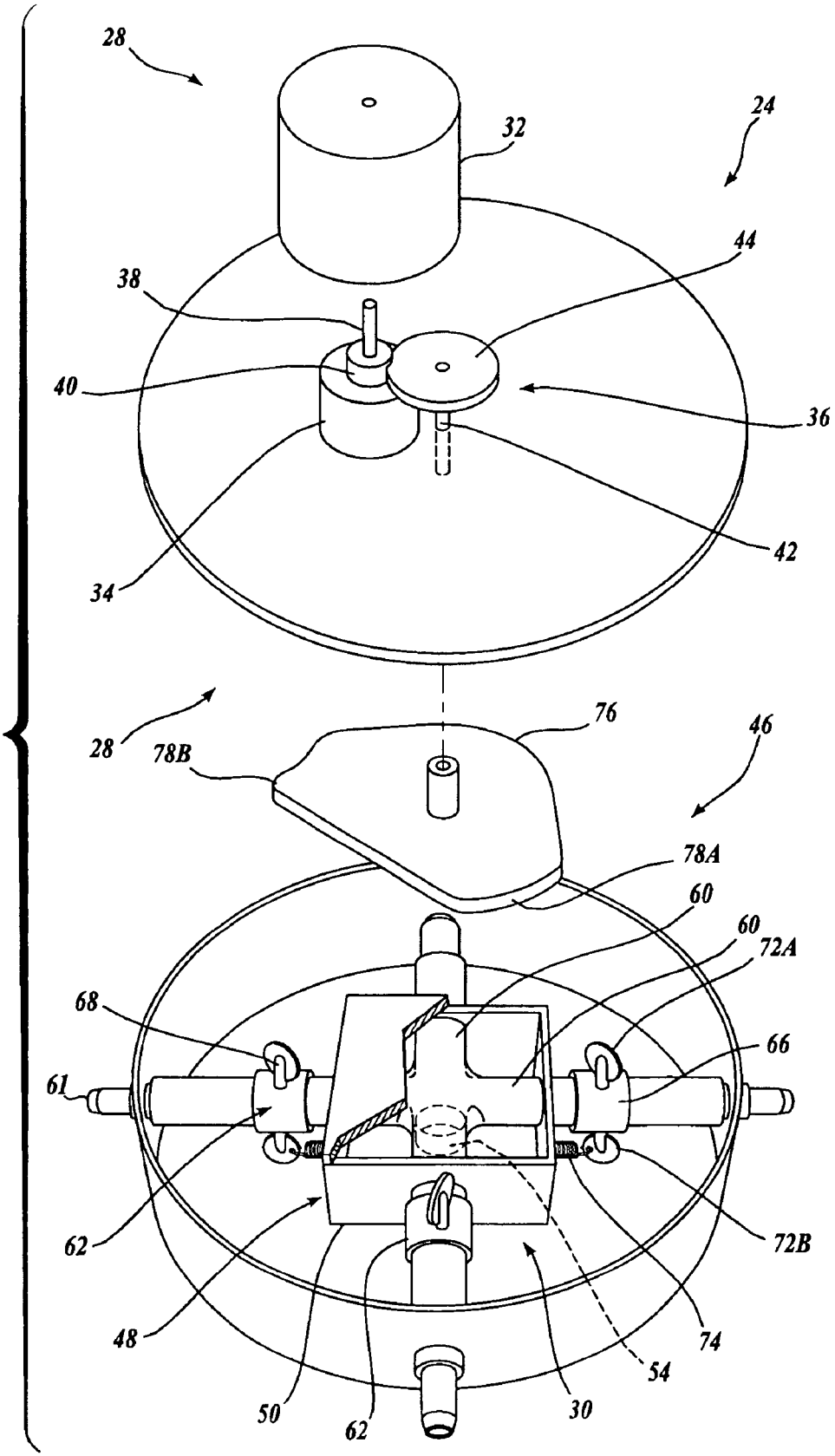
FIG. 4 is an isometric exploded view of the operating assembly of FIG. 3.

Referring to FIGS. 2–4, this detailed description will now focus upon the structure of the operating assembly 24 housed within the head and base portions 16 and 18 of the water toy 10. The operating assembly 24 includes a drive assembly 28 and a water distribution assembly 30.

The drive assembly 28 includes a drive unit 32, a reduction gear system 34, and a driveline assembly 36. The drive unit 32 may be any well known drive means, including an electric motor, hydro motor, hydraulic motor, pneumatic motor, wind up motor, or any other suitable drive unit able to output a force. In the illustrated embodiment, the drive unit 32 is a high speed battery powered electric motor. The drive unit 32 is operatively connected to the switch 20 (See FIG. 1) such that actuation of the switch selectively toggles the drive unit 32 between an energized and running condition, and a de-energized, non-running condition.

The reduction gear system 34 is a well known unit able to receive a high revolution per minute (RPM) input, and through gearing, translate the high RPM input into a low RPM output. In the illustrated embodiment, the high RPM input enters the reduction gear system 34 through a drive unit output shaft 38. The low RPM output exits the reduction gear system 34 through a pinion gear 40 concentrically located about, but not attached, to the output shaft 38. Moreover, the output shaft 38 may pass through the pinion gear 40 such that the pinion gear 40 may spin about the output shaft 38.

The driveline assembly 36 transfers power produced by the drive unit 32 to the reduction gear system 34 and transfers power from the reduction gear system 34 to the water distribution assembly 30. The driveline assembly 36 includes the above mentioned output shaft 38 and pinion gear 40, plus a water distribution assembly input shaft 42 and a bull gear 44. The bull gear 44 is sized and positioned to cooperatively mesh with the pinion gear 40. The input shaft 42 is coupled to the bull gear 44 and transfers any forces present in the bull gear 44 to the water distribution assembly 30. As should be apparent to those skilled in the art, the reduction gear system 34 may be eliminated depending upon the output RPM of the drive unit 32. More specifically, if the RPM of the drive unit 32 is sufficiently slow, than the reduction gear system 34 may not be needed and eliminated, such that the drive unit 32 drives the input shaft 42 directly.

This detailed description will now focus upon the water distribution assembly 30. The water distribution assembly 30 includes two main sub assemblies, a water manifold system 48 and a valve drive system 46. The water manifold system 48 includes a water manifold 50 and one or more valves 62 coupled in fluid communication with the water manifold 50. The water manifold 50 includes a water inlet 54 for directing water into the water manifold 50. The water manifold system 48 may include a fastener 56 for permitting a water hose 58, such as a common garden hose, to be coupled in fluid communication with the water inlet 54.

Referring to FIG. 4, the water inlet 54 is coupled in fluid communication with four arterial passages 60 disposed in the water manifold 50. Each arterial passage 60 directs water obtained from the water inlet 54 to a respective valve 62. Each valve 62 may be selectively actuated between an open position in which water is permitted to be discharged from an associated outlet 61 and a closed position in which water is impeded from discharging from an associated arm. The valves 62 of the illustrated embodiment are illustrated and described as well known butterfly valves, however it should be apparent to those skilled in the art that the valves are illustrative in nature and may take any form in which the flow of a fluid may be selectively permitted to pass and be blocked.

Turning to FIG. 2, each valve 62 includes a disc 70 disposed in a valve body 66. A stem 68 passes through the valve body 66 and is selectively rotatable therein. Coupled to the stem 68 is the disc 70. The disc 70 is rotatable within the valve body 66 between a first position, wherein the disc 70 substantially blocks fluid flow through the valve body 66, and a second position wherein the disc 70 permits fluid flow through the valve body 66. Coupled to each end of the stem 68 are actuation members 72, which in the illustrated embodiment, are paddle shaped. A spring 74 is coupled to each of the lower actuation members 72B, the spring 74 adapted to bias the discs 70 in the closed position. Coupled to the discharge sides of each of the valves 62 are the arms 14 of the water toy 10.

Figure 5:
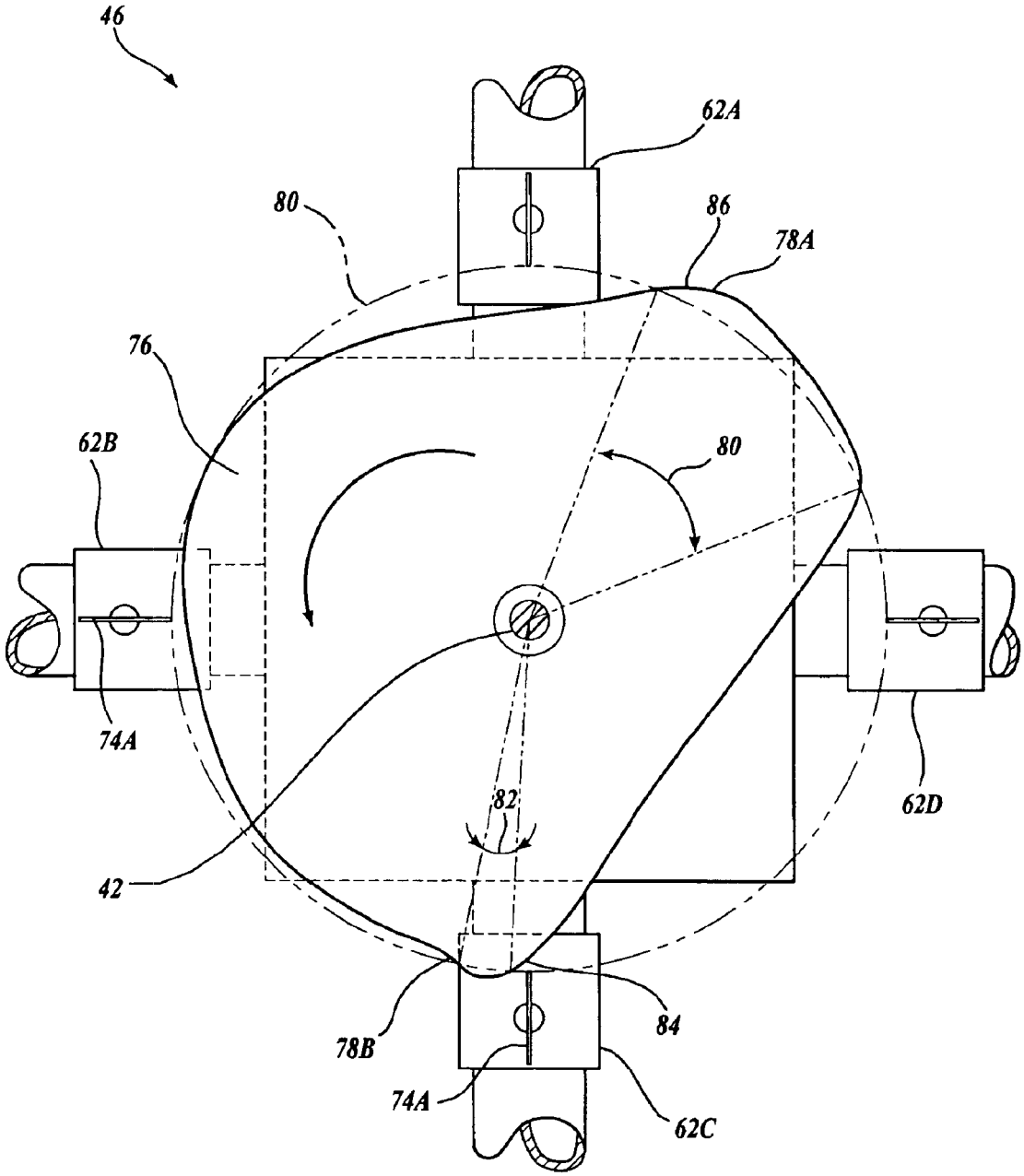
FIG. 5 is a top view of a distribution assembly of the operating assembly depicted in FIG. 3 with a cam of a valve drive system shown in a first position.

Turning now to FIG. 5, the valve drive system 46 includes a cam 76 rigidly mounted to the input shaft 42. The cam 76 may be a planar structure having one or more lobes 78. In the illustrated embodiment, the cam 76 includes a first lobe 78A and a second lobe 78B. The lobes 78 may be defined as any part of the cam 76 extending beyond a base circle 80. In the illustrated embodiment, the radius of the base circle 80 is equal to the distance between the center of the cam 76 and the closest point of an actuation member 74A engageable by the cam 76.

The placement and shape of the lobes 78 upon the cam may be selected to selectively control the discharge of water from the arms. More specifically, the shape of the lobes 78 may be selected to control the duration that water is discharged from the arms. For instance, if a lobe 78 is desired that results in water discharging from an arm for an extended period, then an angular displacement 80 of the portion of the lobe 78 which extends beyond the base circle 80 is increased. For example, lobe 78A is an extended duration lobe relative to lobe 78B for the angular displacement 82 of the portion of lobe 78B which extends beyond the base circle 80 is less than the angular displacement 80 of the portion of lobe 78A which extends beyond the base circle 80.

Further, the rate at which the valve is opened may be manipulated be selectively shaping the lobe 78. A steep rise in a leading edge of the lobe results in a quick valve opening, such as shown in a leading edge 84 of lobe 78B. A slow rise in a leading edge of the lobe conversely results in a slow valve opening, such as shown in a leading edge 86 of lobe 78A.

The shape of the lobe 78 may also be selected to manipulate the extent to which the valve 62 is opened. For instant, if it is desired that the valve be opened only partially, than the distance which the lobe 78 extends outward from the base circle is reduced. Conversely, if it is desired that the valve be opened more fully, than the distance which the lobe 78 extends outward from the base circle is increased. For instance, lobe 78B will open valve 62C less than lobe 78A will open valve 62A for this reason.

Although the cam 76 is described as including two lobes 78, it should be apparent to those skilled in the art that the number of lobes 78 is illustrative in nature, and any number of lobes 78, from one to near infinity, may be placed upon the cam 76. Further, although a single cam 76 is illustrated, it should be noted that multiple cams 76 may be incorporated into the water toy 10 without departing from the spirit and scope of the present invention. Preferably, in a multi-cam configuration of the invention, the cams would rotate at different speeds relative to one another to increase the appearance of a random firing order of the water streams 12.

Referring to FIGS. 1 and 2, in light of the above description of the water toy 10, this detailed description will now focus upon describing the operation of the illustrated water toy 10. The water toy 10 is first placed in an area of play, such as a yard, and coupled to a water hose 58 through the fastener 56. A valve (not shown) is actuated to permit water to flow through the water hose 58 and into the water toy 10. The timer 22 may then be set for a selected period of play. The switch 20 may then be hit to start play, and more specifically, to start the drive assembly 28 such that the valve drive system 46 is put in motion. The arms 14 are then selectively actuated to discharge streams of water 12 out of the arms in a preferably confusing pattern or firing order. Players partaking in the game try to actuate the switch 20 to turn off the water toy 10 prior to the timer 22 indicating the end of the play period without being hit by a stream of water 12. The players may actuate the switch 20 by throwing objects, such as bean bags, balls, rings, etc., or by running up and activating the switch 20 by hand. The object of the game is to actuate the switch 20 prior to the timer 22 indicating the end of play without being hit by water 12 ejected from one of the arms 14. To increase or decrease the difficulty of the game, the time period in which the task must be completed may be increased or decreased respectfully. Further, to increase and decrease the difficulty of the game, the speed at which the cam rotates may be increased or decreased respectfully.

Figure 6:
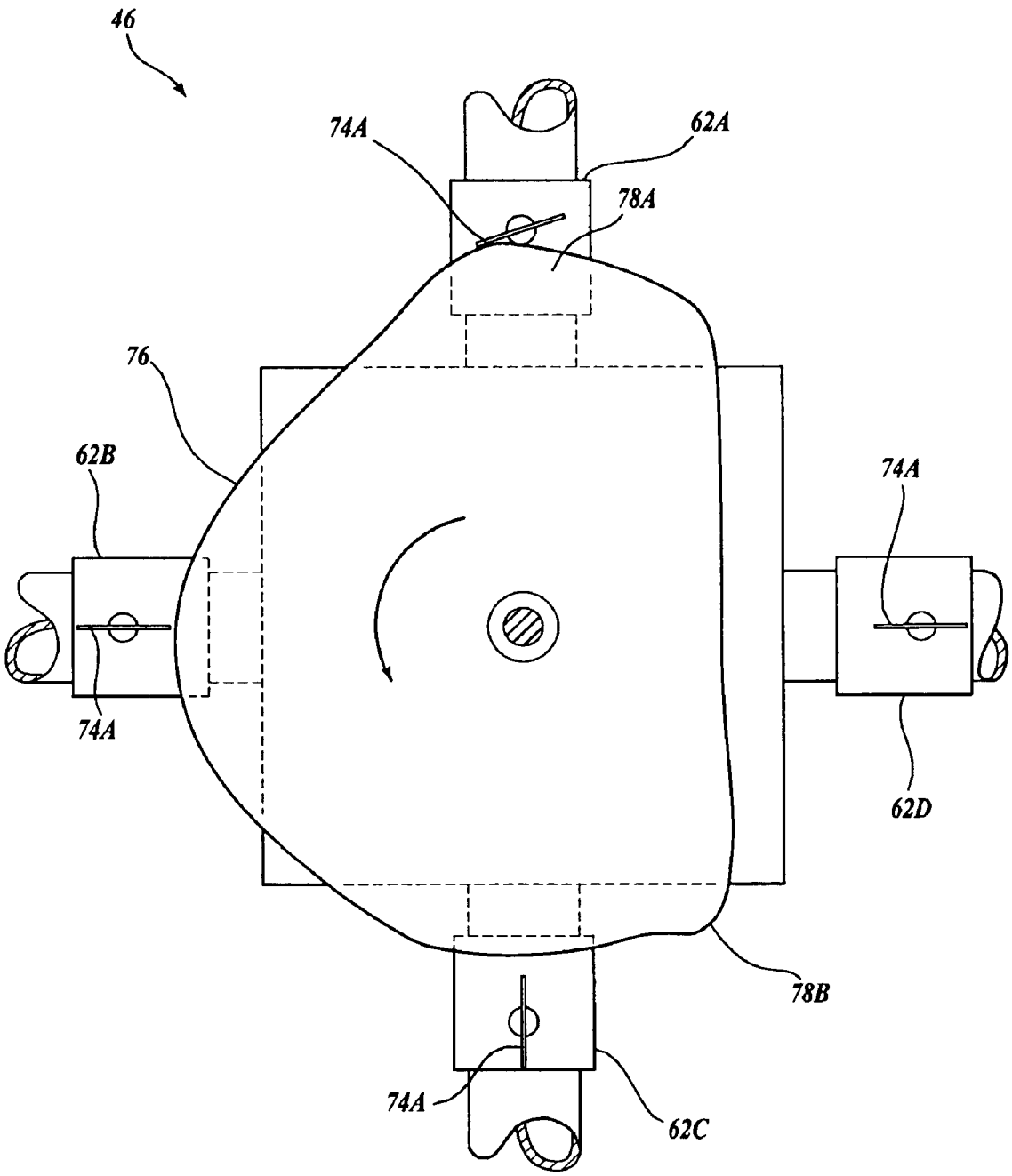
FIG. 6 is a top view of the distribution assembly of the operating assembly depicted in FIG. 3 with the cam of the valve drive system shown in a second position.
Figure 7:
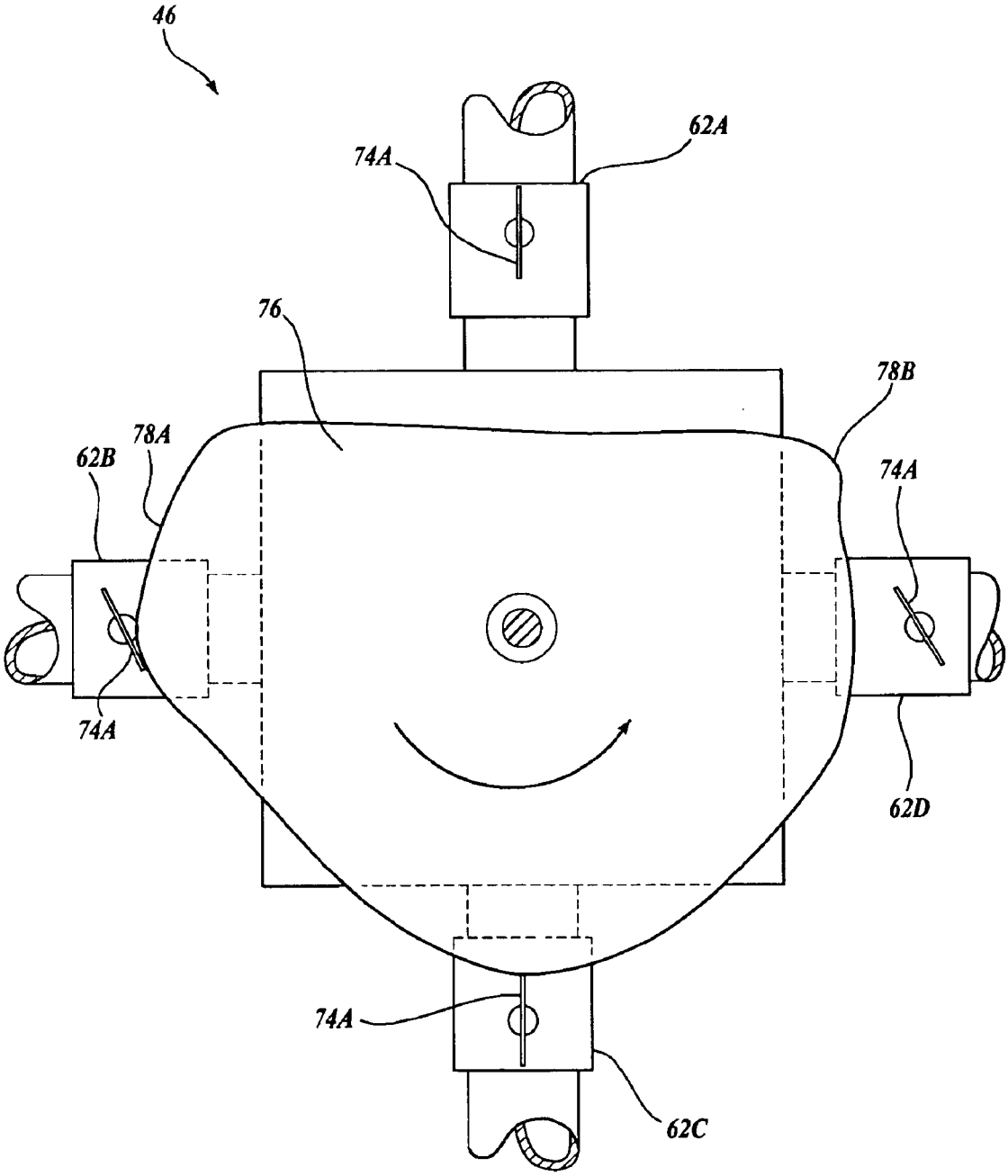
FIG. 7 is a top view of the distribution assembly of the operating assembly depicted in FIG. 3 with the cam of the valve drive system shown in a third position.

Referring to FIGS. 5–7, the operation of the valve drive assembly 46 will now be examined in further detail. Turning to FIG. 5, the cam 76 is shown in a first position. In this position, all of the valves 62 are in a closed position such that water is impeded from flowing from the valves 62. Lobe 78B is depicted just prior to the moment when the actuation member 74A is initially engaged by lobe 78B. Further rotation of the cam 76 in the counterclockwise direction from the first position depicted in FIG. 5 will cause lobe 78B to engage and rotate actuation member 74A clockwise, thereby opening valve 62C.

When the switch of the water toy is actuated, the drive assembly initiates rotation of the cam 76 in a counterclockwise direction from the first position depicted in FIG. 5 to a second position depicted in FIG. 6. As the cam 76 rotates to the second position from the position depicted in FIG. 5, lobe 78B actuates valve 62C from the open to the closed position, and due to the shape of lobe 78B, the opening of valve 62C results in a short burst of water from valve 62C. Referring to FIG. 6, lobe 78A has now engaged the actuation member 74A of valve 62A, thereby opening valve 62A. Due to the shape of lobe 78A, the valve is opened in a manner to provide a prolonged burst of water out of valve 62A. Lobe 78B has already passed actuation member 74A, intermittently opening valve 62C such that a short burst of water is emitted from valve 62C. In the depicted position of the cam 76, valves 62B, 62C, and 62D are depicted in closed positions.

As the rotation of the cam 76 continues from the second position depicted in FIG. 6 to a third position depicted in FIG. 7, lobe 78B actuates valve 62D to emit a short burst of water, followed by lobe 78A actuating valve 62B to emit a long duration burst. Thus, from the above description, it should be apparent that the firing order from counterclockwise rotation of the cam 76 from the position depicted in FIG. 5 during one full rotation of the cam 76 is as follows:

| VALVE | TYPE OF BURST |
|---|---|
| Valve 62C | Short burst |
| Valve 62A | Long burst |
| Valve 62D | Short burst |
| Valve 62B | Long burst |
| Valve 62A | Short burst |
| Valve 62C | Long burst |
| Valve 62B | Short burst |
| Valve 62D | Long burst |

The above tabulated firing order is repeated for every revolution of the cam 76. The firing order may be reduced or increased in complexity by removing or adding valves, lobes, and/or cams as discussed within this detailed description.

Although the illustrated water toy 10 is depicted with four arms 14, it should be apparent to those skilled in the art that the water toy 10 may be constructed with any number of arms, from one to near infinity. Further, although the water toy 10 is described as emitting water, it should be apparent to those skilled in the art that the water toy 10 may emit any fluid without departing from the spirit and scope of the present invention.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A water toy comprising:

(a) a housing;

(b) an inlet for directing liquid into the housing;

(c) a distribution assembly disposed in the housing and coupled in fluid communication with the inlet, wherein the distribution assembly includes a plurality of valves in communication with the inlet;

(d) a plurality of outlets each adapted to direct a stream of liquid out of the housing, the outlets coupled in fluid communication with the valves of the distribution assembly, wherein the distribution assembly intermittently directs a stream of liquid out through the valves and through each of the outlets;

(e) a valve drive assembly, wherein the valve drive assembly comprises a cam, wherein the cam is rotatable such that a lobe of the cam engages the valves when rotated to actuate the valves to selectively impede and permit flow of the liquid through the valves; and (f) an arm coupled to one of the plurality of outlets, the arm actuatable from a limp state to a rigid state when the distribution assembly directs a stream of liquid out of the outlet.

2. The water toy of claim 1, further comprising a switch in communication with the distribution assembly, wherein the switch is actuatable into a first position in which the distribution assembly is incapacitated such that the distribution assembly no longer intermittently directs a stream of liquid out of each of the outlets.

3. The water toy of claim 2, wherein the switch is located on an outer surface of the housing and configured to be actuated into the first position when struck by an object thrown by a user.

4. The water toy of claim 1, wherein the cam includes a plurality of lobes disposed on the cam, wherein each lobe is adapted to actuate each of the plurality of valves as the cam is rotated.

5. The water toy of claim 4, wherein a first lobe of the plurality of lobes is shaped to permit flow through the valves a first duration, and wherein a second lobe of the plurality of lobes is shaped to permit flow through the valves a second duration.

6. The water toy of claim 1, further comprising a timer, wherein the timer is actuatable to operate for a selected duration, wherein at the end of the selected duration, the timer indicates to a user the end of the selected duration.

7. A water toy comprising;

(a) a plurality of outlets;

(b) a water distribution system for directing intermittent streams of liquid out of each of the outlets, wherein the distribution assembly includes a plurality of valves, each valve coupled in fluid communication with one of the plurality of outlets, each valve having an open position in which liquid is permitted to flow through the valve and a closed position in which liquid is impeded from flowing through the valve;

(c) a timer for indicating an end of a selected duration of play;

(d) a switch for incapacitating the water distribution system from directing intermittent streams of liquid out of each of the outlets upon manual actuation of the switch into a first position by a user;

(e) a valve drive assembly, wherein the valve drive assembly comprises a cam, wherein the cam is rotatable such that a lobe of the cam engages the valves when rotated to actuate the valves between the open and closed positions; and (f) an arm coupled to one of the plurality of outlets, the arm actuatable from a limp state to a rigid state when the distribution assembly directs an intermittent stream of liquid out of the outlet.

8. The water toy of claim 7, wherein the cam includes a plurality of lobes disposed on the cam, each of the plurality of lobes adapted to actuate each of the plurality of valves between the open and closed positions as the cam is rotated.

9. The water toy of claim 8, wherein a first lobe of the plurality of lobes is shaped to maintain the valves in the open position a first duration, and wherein a second lobe of the plurality of lobes is shaped to maintain the valves in the open position a second duration.

10. The water toy of claim 7, wherein the switch is located on an outer surface of the housing and configured to be actuated into the first position when struck by an object thrown by a user.

11. A water toy comprising:

(a) a distribution assembly having a plurality of outlets for selectively directing an intermittent stream of liquid out of each of a plurality of outlets, the distribution assembly including a plurality of valves each associated with one of the plurality of outlets, wherein each of the valves are actuatable between an open position in which a stream of liquid is discharged from one of the plurality of outlets and a closed position in which the stream of liquid is impeded from discharging from the outlet;

(b) a valve drive assembly comprising a rotatable cam having a plurality of lobes, wherein each of the plurality of lobes is adapted to actuate each of the plurality of valves between the open and closed positions as the cam is rotated; and (c) an arm coupled to one of the plurality of outlets, the arm actuatable from a limp state to a rigid state when the distribution assembly directs liquid out of the outlet.

12. The water toy of claim 11, further comprising a switch in communication with the valve drive assembly, wherein when the switch is actuated into a first position, the valve drive assembly is incapacitated such that the valve drive assembly ceases the rotation of the cam.

13. The water toy of claim 12, wherein the switch is located on an outer surface of the housing and configured to be actuated into the first position when struck by an object thrown by a user.

14. The water toy of claim 11, wherein a first lobe of the plurality of lobes is shaped to maintain the valves in the open position a first duration, and wherein a second lobe of the plurality of lobes is shaped to maintain the valves in the open position a second duration.

15. The water toy of claim 11, further comprising a timer actuatable to operate for a selected duration, wherein at the end of the selected duration, the timer indicates to a user the end of the selected duration.

* * * * *